US012263390B2

(12) United States Patent
Xing

(10) Patent No.: US 12,263,390 B2
(45) Date of Patent: Apr. 1, 2025

(54) TABLE TENNIS TABLE

(71) Applicant: EastPoint Sports Ltd., LLC, Succasunna,, NJ (US)

(72) Inventor: Changwei Xing, Huizhou (CN)

(73) Assignee: EASTPOINT SPORTS LTD., LLC, Succasunna, NJ (US)

( * ) Notice: Subject to any disclaimer, the term of this patent is extended or adjusted under 35 U.S.C. 154(b) by 395 days.

(21) Appl. No.: 17/655,251

(22) Filed: Mar. 17, 2022

(65) Prior Publication Data

US 2022/0401808 A1 Dec. 22, 2022

(30) Foreign Application Priority Data

Jun. 22, 2021 (CN) ..... 202121406763.8

(51) Int. Cl.

| | |
|---|---|
| ***A63B 67/04*** | (2006.01) |
| ***A47B 3/00*** | (2006.01) |
| ***A47B 25/00*** | (2006.01) |
| *A63B 102/16* | (2015.01) |

(52) U.S. Cl.

CPC ..... *A63B 67/04* (2013.01); *A47B 3/002* (2013.01); *A47B 25/003* (2013.01); *A63B 2102/16* (2015.10); *A63B 2210/50* (2013.01)

(58) Field of Classification Search

CPC . A63B 67/04; A63B 2102/16; A63B 2210/50; A47B 3/002; A47B 25/003

See application file for complete search history.

(56) References Cited

U.S. PATENT DOCUMENTS

| | | | |
|---|---|---|---|
| 1,995,543 A | 3/1935 | Everett | |
| 2,569,007 A | 9/1951 | Klyce | |
| 2,595,725 A | 5/1952 | Sutton | |
| 5,645,259 A | 7/1997 | Chen | |

(Continued)

FOREIGN PATENT DOCUMENTS

| | | | | |
|---|---|---|---|---|
| CN | 217510097 U | * | 9/2022 | ..... A47B 25/003 |
| CN | 117530535 A | * | 2/2024 | ..... A47B 25/003 |

(Continued)

OTHER PUBLICATIONS

Dick's Sporting Goods advertisement dated Dec. 10, 2018.

(Continued)

*Primary Examiner* — Raleigh W Chiu

(74) *Attorney, Agent, or Firm* — Shane Delsman; Godfrey & Kahn, S.C.

(57) ABSTRACT

The present disclosure provides a table tennis table. Compared with the existing design, according to the present disclosure, a whole table tennis table is divided into two table tennis table boards, and each table tennis table board can be folded into two plates. On one hand, the table board can be folded, which is convenient to transport. On the other hand, because of the setting of first articulation pieces, second articulation pieces, third articulation pieces, and fourth articulation pieces, the table board can be supported directly by folding and connection relationship without special installation of the supporting feet and the fixing feet. For each table tennis table board, a consumer only needs to rotate two fixing screws to use the table tennis table, which is more convenient and simpler than the traditional way to install the table legs.

10 Claims, 6 Drawing Sheets

(56) References Cited

U.S. PATENT DOCUMENTS

| | | | |
|---|---|---|---|
| D411,387 | S | 6/1999 | Zheng |
| D425,568 | S | 5/2000 | Muraki et al. |
| 6,073,894 | A | 6/2000 | Chen |
| 6,079,338 | A | 6/2000 | Yeh |
| 6,564,402 | B1 | 5/2003 | Lin |
| 7,137,911 | B2 | 11/2006 | Giegerich |
| 7,156,763 | B1 | 1/2007 | Liao |
| 7,229,128 | B2 | 6/2007 | Lee |
| 7,485,053 | B2 | 2/2009 | Nally |
| 8,062,153 | B2 | 11/2011 | Boseman |
| 8,074,669 | B2 | 12/2011 | Collins et al. |
| 8,122,536 | B2 | 2/2012 | Peixin et al. |
| 8,245,332 | B2 | 8/2012 | Yul et al. |
| D666,464 | S | 9/2012 | Austin |
| 8,641,562 | B1 | 2/2014 | Tuttle |
| D714,411 | S | 9/2014 | Chen |
| D724,686 | S | 3/2015 | Bonacina et al. |
| D748,407 | S | 2/2016 | Akkad |
| D809,083 | S | 1/2018 | Fritschy |
| 2011/0177893 | A1* | 7/2011 | Abramson ..... A47B 25/003 473/496 |
| 2020/0023255 | A1 | 1/2020 | Webb et al. |

FOREIGN PATENT DOCUMENTS

| | | | | |
|---|---|---|---|---|
| KR | 102456249 | B1 * | 10/2022 | ..... A47B 3/0803 |
| KR | 20240037562 | A * | 3/2024 | ..... A47B 87/002 |

OTHER PUBLICATIONS

Dick's Sporting Goods advertisement dated Dec. 17, 2018.
Dick's Sporting Goods advertisement dated Dec. 3, 2018.
Photograph of Pingpong the Original 3 in 1 pop-up table tennis set.

* cited by examiner

TABLE TENNIS TABLE

TECHNICAL FIELD

The present disclosure relates to the field of a table tennis table, and in particular to a table tennis table.

BACKGROUND

In the manufacturing process of a table tennis table, the table tennis table needs a relatively large table board, and moreover, needs a relatively complete table board as a whole. The existing table tennis table board is generally a whole table board or composed of two opposing table boards spliced together. However, the two types of table boards are relatively large, which is not conducive to handling, assembly and transportation. At the same time, it is not easy for the two types of existing table tennis tables to be installed, and the tables will be uneven if the table legs are not installed well, which greatly affects the user experience.

SUMMARY

The present disclosure provides a table tennis table, which solves the problems of inconvenient transportation of the existing table tennis table and troublesome installation of the table legs thereof.

In order to solve the above technical problems, the technical solution of the present disclosure is as follows: a table tennis table, including two movably-spliced table tennis table boards, wherein each of the table tennis table boards includes two symmetrically-arranged folding plates, two symmetrically-arranged supporting feet, and two symmetrically-arranged fixing feet for fixing the supporting feet; a first articulation piece for movable folding is arranged between the two symmetrically-arranged folding plates, a second articulation piece is arranged on a side of each of the two symmetrically-arranged folding plates, and a fourth articulation piece is arranged on a top edge of each of the two symmetrically-arranged folding plates; the two supporting feet are symmetrically arranged on both sides of the two folding boards, the supporting feet are movably connected to the folding plates through the second articulation pieces, the two fixing feet are symmetrically arranged on top edges of the folding plates, and the two symmetrically-arranged fixing feet are movably connected through the fourth articulation pieces.

Preferably, each fixing foot of the two symmetrically-arranged fixing feet includes a first fixing foot and a second fixing foot; and the first fixing foot is fixedly connected to the second fixing foot.

Preferably, a third articulation piece for a movable folding connection is arranged respectively between two opposite first fixing feet of the two symmetrically-arranged fixing feet and between two opposite second fixing feet of the two symmetrically-arranged fixing feet.

Preferably, the third articulation piece includes two joints that are symmetrically arranged with each other and a joint shaft, the two joints are fixed by the joint shaft, and the joints are fixedly connected to the first fixing feet.

Preferably, fixing screws for a fixed connection are arranged between the supporting feet and the fixing feet.

Preferably, the first articulation piece is a hinge joint articulation piece.

Preferably, both the second articulation piece and the fourth articulation piece are rotation shaft articulation pieces.

The beneficial effects achieved by the present disclosure are as follows: compared with the existing design, according to the present disclosure, a whole table tennis table is divided into two table tennis table boards, and each table tennis table board can be folded into two plates; on one hand, the table board can be folded, which is convenient to transport; on the other hand, because of the setting of first articulation pieces, second articulation pieces, third articulation pieces, and fourth articulation pieces, the table board can be supported directly by folding and connection relationship without special installation of the supporting feet and the fixing feet; for each table tennis table board, a consumer only needs to rotate two fixing screws to use the table tennis table, which is more convenient and simpler than the traditional way to install the table legs.

Figure 1:
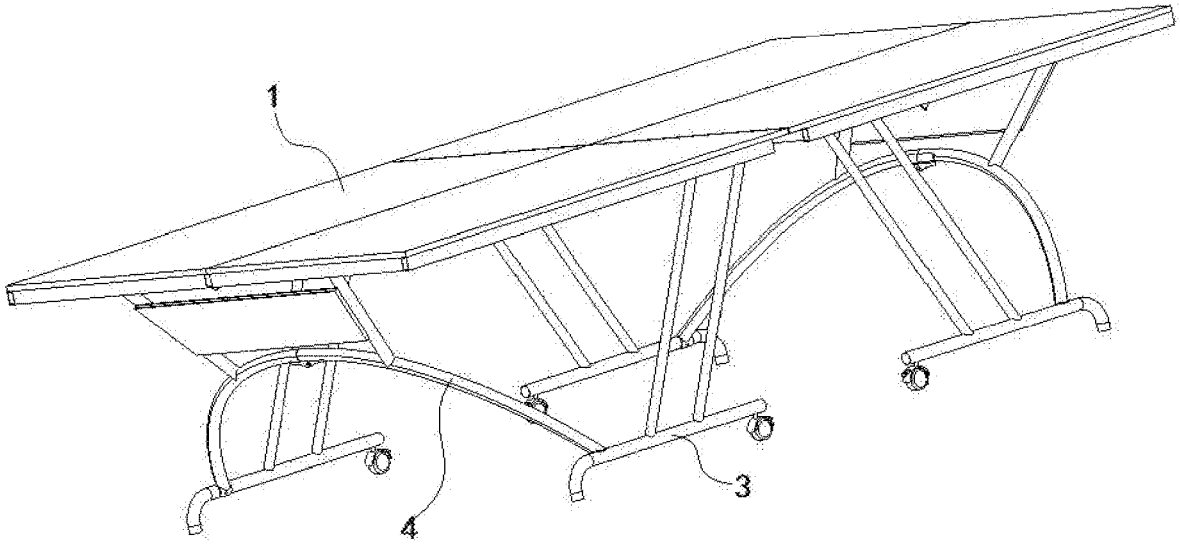
FIG. 1 is a first perspective view of a table tennis table of the present disclosure.
Figure 2:
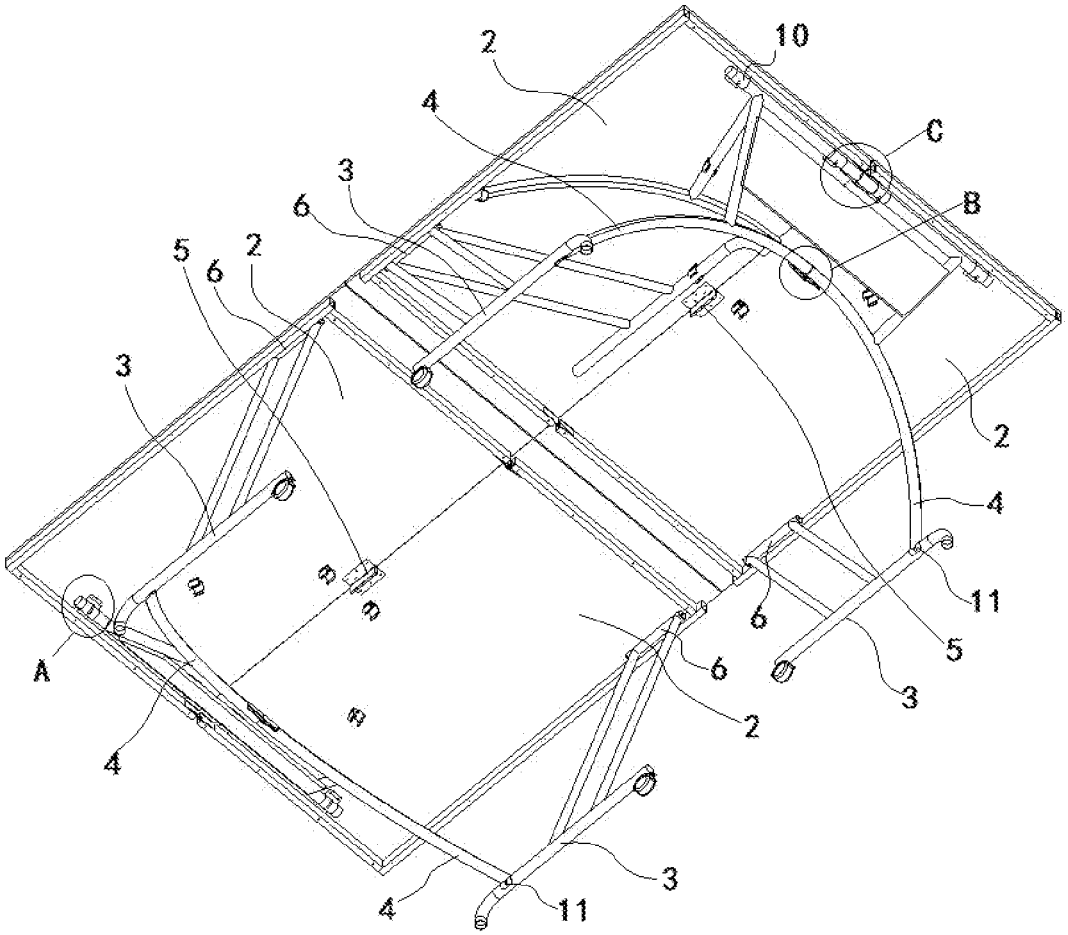
FIG. 2 is a second perspective view of a table tennis table of the present disclosure.
Figure 3:
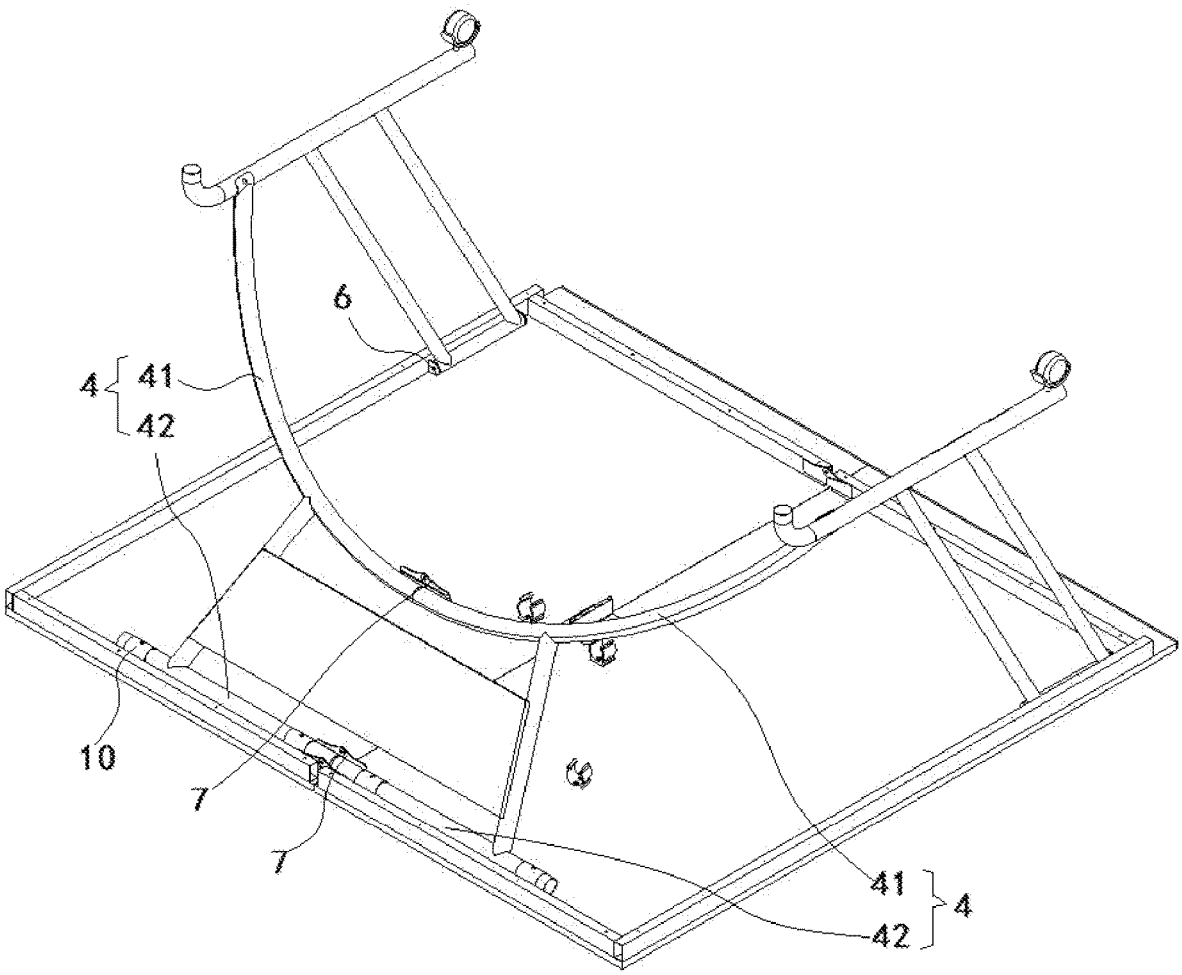
FIG. 3 is a perspective view of a table tennis table board of a table tennis table of the present disclosure.
Figure 4:
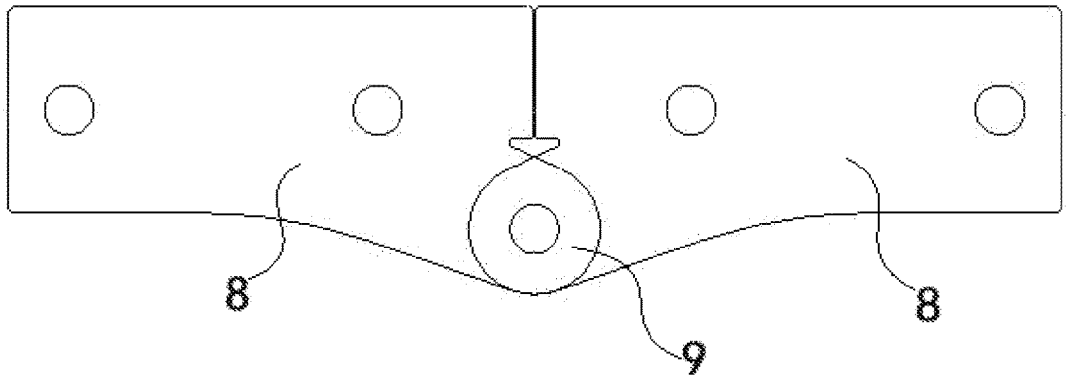
FIG. 4 is a plan view of open joints of a third articulation piece of a table tennis table of the present disclosure.
Figure 5:
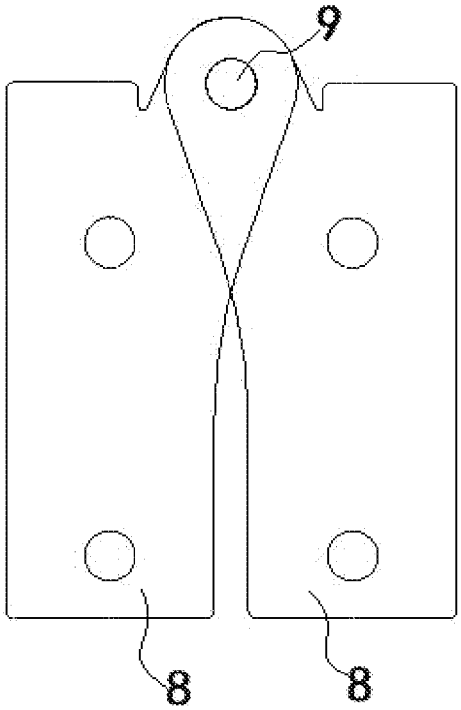
FIG. 5 is a plan view of folded joints of a third articulation piece of a table tennis table of the present disclosure.
Figure 6:
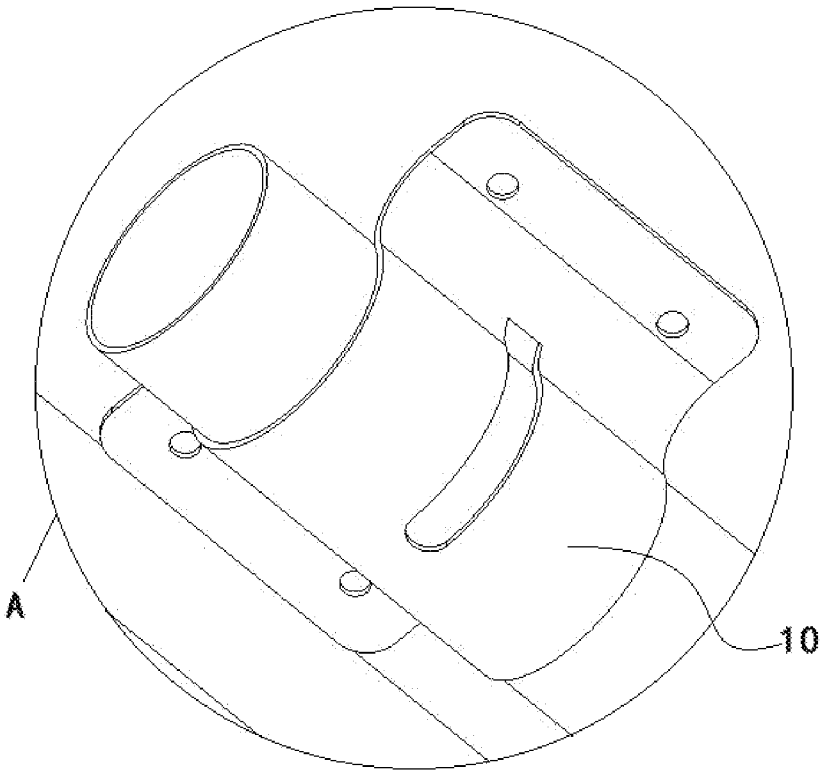
FIG. 6 is an enlarged view of the part A in FIG. 2.
Figure 7:
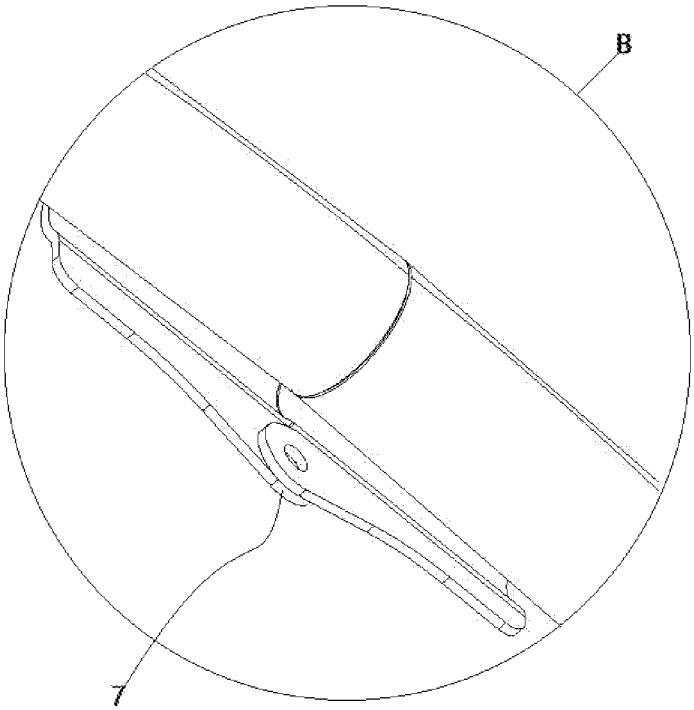
FIG. 7 is an enlarged view of the part B in FIG. 2.
Figure 8:
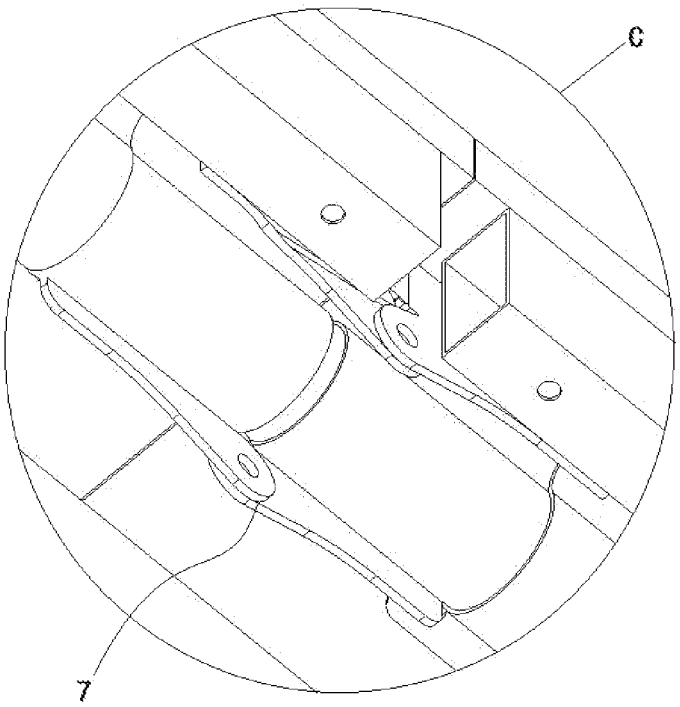
FIG. 8 is an enlarged view of the part C in FIG. 2.

Names of the corresponding parts or process names represented by numbers or letters in the figures: 1. table tennis table board; 2. folding board; 3. supporting foot; 4. fixing foot, 41. first fixing foot, 42. second fixing foot; 5. first articulation piece; 6. second articulation piece; 7. third articulation piece; 8. joint; 9. joint shaft; 10. fourth articulation piece; 11. fixing screw.

The accompanying drawings are only for exemplary description and cannot be understood as a limitation of the present disclosure. In order to better illustrate embodiments, some parts of the accompanying drawings may be omitted, enlarged or reduced, and do not represent the size of the actual product. For those skilled in the art, it is understandable that some well-known structures in the drawings and the description thereof may be omitted. The same or similar reference numerals correspond to the same or similar parts. The terms describing the position relationships in the drawings are only for exemplary description and cannot be understood as a limitation of the present disclosure.

DETAILED DESCRIPTION

In order to facilitate the understanding of those skilled in the art, the present disclosure will be further described in detail below in conjunction with the accompanying drawings and the embodiments, specifically as follows:

As shown in the figures, a table tennis table includes two movably-spliced table tennis table boards 1, wherein each of the table tennis table boards 1 includes two symmetrically-arranged folding plates 2, two symmetrically-arranged supporting feet 3, and two symmetrically-arranged fixing feet 4 for fixing the supporting feet 3; a first articulation piece 5 for movable folding is arranged between the two symmetrically-arranged folding plates 2, a second articulation piece 6 is arranged on a side of each of the two symmetrically-arranged folding plates 2, and a fourth articulation piece 10 is arranged on a top edge of each of the two symmetrically-arranged folding plates 2; the two supporting feet 3 are symmetrically arranged on both sides of the two folding boards 2, the supporting feet 3 are movably connected to the folding plates 2 through the second articulation pieces 6, the two fixing feet 4 are symmetrically arranged on top edges of the folding plates 2, and the two symmetrically-arranged fixing feet 4 are movably connected through the fourth articulation pieces 10.

Particularly, each fixing foot 4 of the two symmetrically-arranged fixing feet 4 includes a first fixing foot 41 and a second fixing foot 42; and the first fixing foot 41 is fixedly connected to the second fixing foot 42.

Particularly, a third articulation piece 7 for a movable folding connection is arranged respectively between two opposite first fixing feet 41 of the two symmetrically-arranged fixing feet 4 and between two opposite second fixing feet 42 of the two symmetrically-arranged fixing feet 4.

Particularly, the third articulation piece 7 includes two joints 8 that are symmetrically arranged with each other and a joint shaft 9, the two joints 8 are fixed by the joint shaft 9, and the joints 8 are fixedly connected to the first fixing feet 41.

Particularly, fixing screws 11 for a fixed connection are arranged between the supporting feet 3 and the fixing feet 4.

Particularly, the first articulation piece 5 is a hinge articulation piece.

Particularly, both the second articulation piece 6 and the fourth articulation piece 10 are rotation shaft articulation pieces.

Obviously, the above embodiments of the present disclosure are merely examples to clearly illustrate the present disclosure, and are not intended to limit the implementation manner of the present disclosure. For those of ordinary skill in the art, other changes or modifications in different forms can be made on the basis of the above description. It is unnecessary and impossible to list all the implementation manners here. Any modification, equivalent replacement and improvement made within the spirit and principle of the present disclosure shall be included in the protection scope of the claims of the present disclosure.

What is claimed is:

1. A table tennis table, comprising:

two movably-spliced table tennis table boards, each of the table tennis table boards further comprising:

two symmetrically-arranged folding plates, the two symmetrically-arranged folding plates attached to each other by a first articulation piece;

two symmetrically-arranged supporting feet, each of the two symmetrically-arranged supporting feet attached to one of the two symmetrically-arranged folding plates by a second articulation piece; and two symmetrically-arranged fixing feet, the two symmetrically-arranged fixing feet attached to each other by a third articulation piece;

two symmetrically-arranged supporting feet, each of the two symmetrically-arranged supporting feet respectfully attached to one of the two symmetrically-arranged folding plates by a fourth articulation piece and to one of the two symmetrically-arranged fixing feet;

wherein the two symmetrically-arranged fixing feet are configured to fix the supporting feet;

wherein the first articulation piece is configured to permit the two symmetrically-arranged folding plates to fold with respect to one another;

wherein each one of the second articulation pieces is respectively arranged on another side of one of the two symmetrically-arranged folding plates opposite the side;

wherein ach of the fourth articulation pieces is respectively arranged on a top edge of one of the two symmetrically-arranged folding plates; and wherein each of the two supporting feet are symmetrically and respectively arranged on the another side of the two symmetrically-arranged folding plates.

2. The table tennis table of claim 1, wherein the two symmetrically-arranged fixing feet further comprises a first fixing foot and a second fixing foot; and wherein the first fixing foot is fixedly connected to the second fixing foot.

3. The table tennis table of claim 2, wherein the first fixing foot of a first one of the two symmetrically-arranged fixing feet and the first fixing foot of a second one of the two symmetrically-arranged fixing feet are connected by the third articulation piece;

wherein the second fixing foot of the first one of the two symmetrically-arranged fixing feet and the second fixing foot of the second one of the two symmetrically-arranged fixing feet are connected by another one of the third articulation piece;

wherein the third articulation piece is configured to permit the first fixing foot of the first one of the two symmetrically-arranged fixing feet to selectively fold with respect to the first fixing foot of the second one of the two symmetrically-arranged fixing feet; and wherein the another third articulation piece is configured to permit the second fixing foot of the first one of the two symmetrically-arranged fixing feet to selectively fold with respect to the second fixing foot of the second one of the two symmetrically-arranged fixing feet.

4. The table tennis table of claim 3, wherein the third articulation piece further comprises two joints that are symmetrically arranged to each other and a joint shaft;

wherein the two joints are fixed to the joint shaft; and wherein one of the two joints is fixedly connected to the first fixing foot of the first one of the two symmetrically-arranged fixing feet and the first fixing foot of the second one of the two symmetrically-arranged fixing feet.

5. The table tennis table of claim 4, wherein one of the two symmetrically-arranged supporting feet is connected to the two symmetrically-arranged fixing feet by a fixing screw.

6. The table tennis table of claim 5, wherein the first articulation piece is a hinge joint articulation piece.

7. The table tennis table of claim 3, wherein at least one of the second articulation pieces and at least one of the fourth articulation piece are rotation shaft articulation pieces.

8. The table tennis table of claim 1, wherein the first articulation piece is a hinge joint articulation piece.

9. The table tennis table of claim 1, wherein at least one of the second articulation pieces and at least one of the fourth articulation piece are rotation shaft articulation pieces.

10. The table tennis table of claim 1, wherein one of the two symmetrically-arranged supporting feet is connected to the two symmetrically-arranged fixing feet by a fixing screw.

* * * * *